United States Patent [19]

Gates

[11] Patent Number: 4,836,701

[45] Date of Patent: Jun. 6, 1989

[54] PAPER TRANSPORT DEVICE FOR PRINTING-INSTALLATIONS

[76] Inventor: Jeffrey L. Gates, 101210 Herb Rd., Windsor, Calif. 95492

[21] Appl. No.: 19,637

[22] Filed: Feb. 27, 1987

[30] Foreign Application Priority Data

Feb. 28, 1986 [DE] Fed. Rep. of Germany ..... 3606670

[51] Int. Cl.[4] ..... B41J 15/04

[52] U.S. Cl. ..... 400/617; 400/636

[58] Field of Search ..... 400/617, 618, 636, 636.3; 101/219, 228, 216, 220

[56] References Cited

U.S. PATENT DOCUMENTS

| | | | |
|---|---|---|---|
| 1,095,063 | 4/1914 | Amador | 400/618 |
| 4,034,842 | 7/1977 | Giacone | 400/617 |
| 4,197,024 | 4/1980 | Huntoon | 400/636 |

FOREIGN PATENT DOCUMENTS

| | | | |
|---|---|---|---|
| 0141786 | 9/1982 | Japan | 400/636 |
| 0038189 | 2/1985 | Japan | 400/617 |

*Primary Examiner*—Edgar S. Burr
*Assistant Examiner*—James Lisehora
*Attorney, Agent, or Firm*—Morse, Altman, Dacey & Benson

[57] ABSTRACT

The invention concerns a paper transport device with cylinders to guide the continuous form paper towards and away from printing devices in which a cylinder pulling the paper into, a cylinder guiding the paper out and a cylinder pulling tight the paper are deposited revolvingly in parallel of their axis, whereby the cylinder pulling the paper in and the cylinder guiding the paper out are installed in some distance and at the same time working together and the spindle of the cylinder guiding the paper out is to be driven by means of power transmitting devices of the spindle of the cylinder pulling the paper in.

8 Claims, 3 Drawing Sheets

PAPER TRANSPORT DEVICE FOR PRINTING-INSTALLATIONS

BACKGROUND OF THE INVENTION

1. Field of the Invention

The present invention concerns a paper transport device with cylinders to lead a continuous form paper into and out of a printing installation.

2. Description of the Related Art

Such installations as the printers of electronic computer systems often handle continuous form paper. The paper to be printed on has to be led continuously into the printing device and, after printing, has to be guided continuously out of the printing device. The paper transport is relatively often interrupted by disturbances that may cause the paper to become jammed or blocked. Unreadable print may be the result. Satisfactory paper transport is even more difficult when such a printing device is combined with a sound cover or completely confined in a sound cover box. In such a case, the continuous form paper has to be guided additionally through the sound cover box or the sound cover. Each additional opening means that the sound protection is less.

Different possibilities have been tried to provide an undisturbed paper transport inside and out of printing devices. It is also, for example, well known to lead the continuous form paper over rods, tubes or wooden cylinders to lower tension in the advancing paper. Similarly, special guide posts and wheels have been used to keep movement of the paper in a predetermined direction.

In this context, sound covers have been used in the prior art. In these cases, the continuous form paper from the paper-pile is guided through a slit in the backside of the sound cover to the printing installation. Inside the sound cover, the paper-edges of the continuous form paper are shielded by special devices on the way between the already mentioned slit and the printing installation. When the paper has gone through the printing installation it is guided through a second slit, which is spaced from the first one, outside of the sound cover. The continuous form paper is then collected on a table, on the floor, or in a basket.

But within such sound covers, disturbances in the advancing continuous form paper are frequent. This is especially unpleasant in cases of emergency when nobody is available to clear the way for the paper immediately on the occurrence of a disturbance. Furthermore, the sound of a disturbance within a sound cover often is not transmitted through the entrance and exit slits of the sound cover so that disturbances are difficult to monitor.

The object of the present invention is to provide a paper transport device to guide continuous form paper into and out of a printing device over a long time-period without disturbance. Also, the transport device, when combined with a sound cover or sound cover box for the printing device, guarantees the desired sound proof condition.

SUMMARY OF THE INVENTION

Structurally, the present invention contemplates a printing system having a paper input port and a paper output port, which printing system comprises a printing cylinder, an input cylinder, an output cylinder, and a compression cylinder, the axes of the printing cylinder, the input cylinder, the output cylinder, and the compression cylinder being parallel, the input cylinder and the output cylinder being remote from each other, the compression cylinder being loaded for compression against both the input cylinder and the output cylinder, whereby the system establishes a paper path from the input port, between the input cylinder and the compression cylinder, around the printing cylinder, and between the output cylinder and the compression cylinder to the output port. The arrangement is such that the cylinder which is pulling the paper into and the cylinder which is moving the paper out of the housing are installed at a distance from each other and work together and with the compression cylinder, with help of power transmissing devices of cog wheels. The motive power is provided by the printing wheel, the arrangement being such that the input cylinder, the output cylinder and the compression cylinder are not independently driven by a motor.

The arrangement is such that movement of the paper itself serves as the power transmitting mechanism, whereby the drive wheels and belt can be produced simply and with little cost. Also, the power transmitting devices are installed so that the output cylinder guiding the paper out rotates with the same or a higher number of rotations compared with the speed of the input cylinder pulling the paper in. Therefore, a constant transport of continuous form paper is provided. It is important that the structure of the present invention excludes the possibility that blocking of the paper path can occur as a result of rotational differences between the input and output cylinders. Furthermore, the higher number of rotations of the cylinder guiding the paper out causes a steady pull on the continuous form paper away from the printing device. This pull is controlled by a slip between the continuous form paper on one side and the output cylinder.

DESCRIPTION OF THE PREFERRED EMBODIMENT

Figure 1:
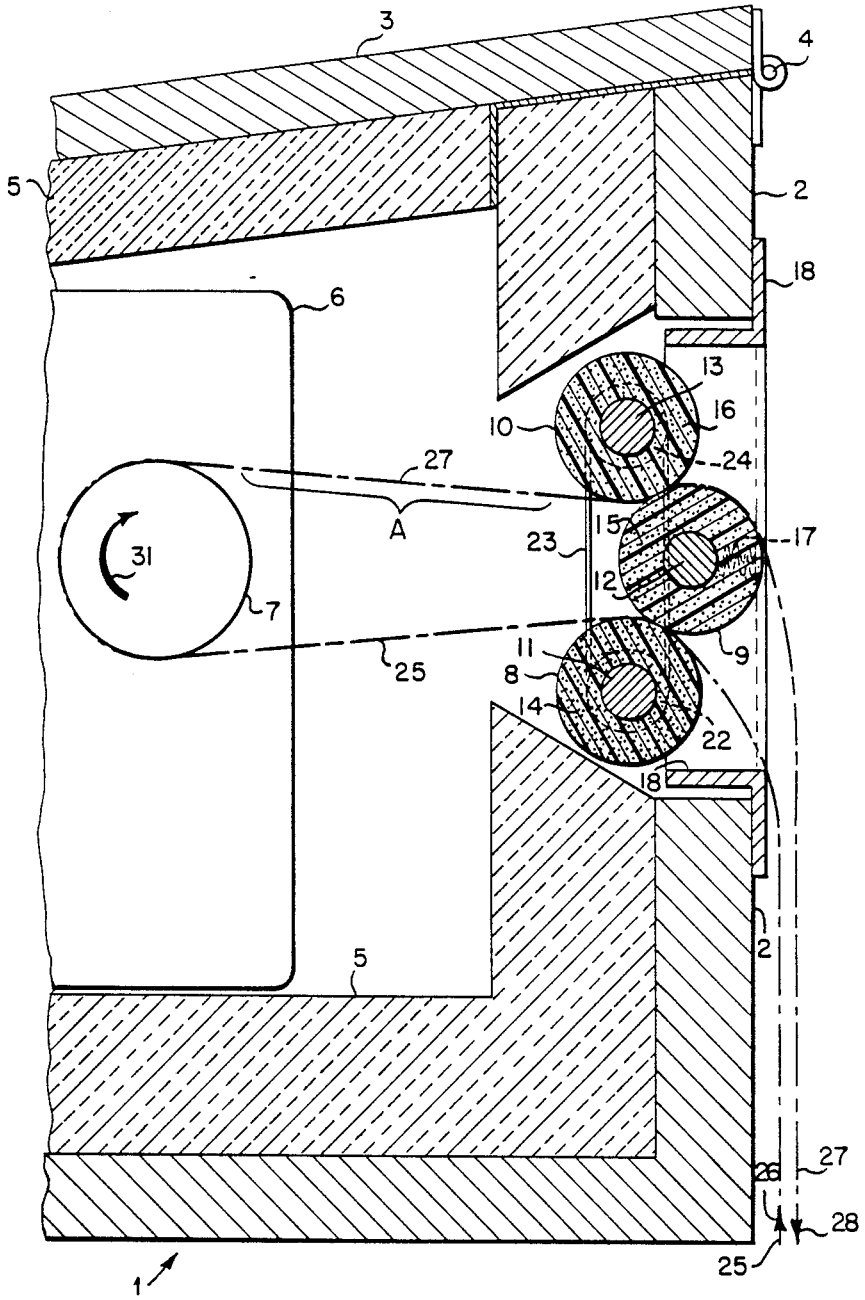
FIG. 1 is a detail drawing of a vertical cut through the paper transport device, which is contained in the back part of a sound cover box for a printing device.

FIG. 1 shows a sound cover box 1 in the vicinity of its back wall 2. The sound cover box 1 is provided with a cover 3 which can be opened and closed, as it is fixed with a hinge. The sound cover box 1 and the cover 3 are equipped inside with a sound isolating cellular foam material 5.

Inside the sound cover box 1 is a printing device 6, for example, the printer of an electronic data processing device, installed with a compression cylinder 9 for tightening the paper around a printing cylinder 7.

In the region of the compression cylinder 9 effecting the tension around printing cylinder 7 in the back wall 2 of the sound cover box 1 is an input cylinder 8 pulling the paper into the sound cover box, and an output cylinder 10 guiding the paper out 10. These cylinders are situated one over the other, each being rotatable. These cylinder 8, 9, 10 have about the same diameter, approximately 30–35 mm, and are constructed with inner metal spindles 11, 12, 13, as well as outer cellular foam surfaces 14, 15, 16. This cellular foam, which contributes to effective sound isolation, is for instance available under the trade name PE 60. The length of each of the cylinders 8, 9, 10, for example, is about 420 mm. The cylinder perimeter is as exactly cylindrical as can be achieved by turning the foam on a lathe.

The input cylinder 8 and the output cylinder 10 are vertically spaced from each other. The distance of this vertical spacing is less than the diameter of the compression cylinder 9. The compression cylinder is positioned outwardly toward the sound cover box 1 and presses inwardly against the two cylinders 8, 10. As shown, a screw spring 17 spring loads the compression cylinder 9 against the input cylinder 8 and the output cylinder 10.

Figure 2:
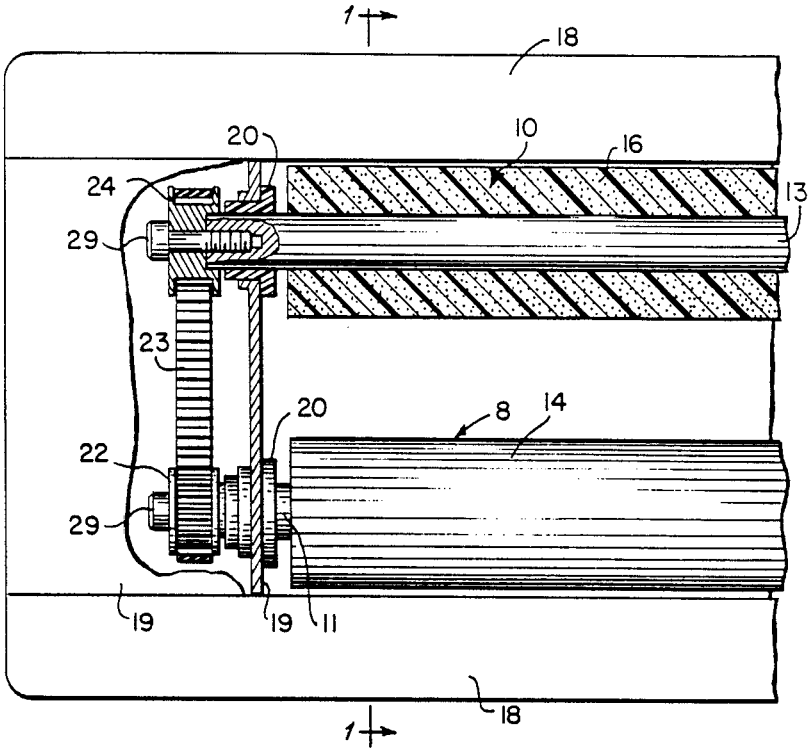
FIG. 2 is a detail drawing of the device according FIG. 1 within the range of the position of the cylinder pulling in the paper and the cylinder guiding the paper out, with parts omitted.

At a frame 18, as shown in FIGS. 2, 3, 4 and 5, are fixed right angle holding plates 19, in which the input cylinder 8, the compression cylinder 9, and the output cylinder 10 are pivotally mounted by means of plastic bushings 20 (compare FIG. 2). The ends of the input cylinder 8 and of the output cylinder 10 revolve at fixed locations in the holding plates, but the ends of the compression cylinder 9 are retained in a notch 21 of the holding plates 19 and kept in position by means of the screw springs. Thus the compression cylinder 9 can be easily taken out of the transport device partly or completely to put for instance continuous form paper into the paper path.

At the end of the metal spindle 11 of the input cylinder 8 is fixed a cog wheel plate 22. At the end of the metal spindle 13 of the output cylinder 10 is fixed a cog wheel plate 24. A cog belt 23 connects the cog wheel plate 22 with the cog wheel plate 24. Thus, the input cylinder 8 and the output cylinder 10 are connected with each other for the transmissing of power.

According to the size of the cog wheel plates 22, 24, the input cylinder 8 and the output cylinder 10 rotate at the same or at different speed. The system consisting of cog wheel plates 22, 24 and cog belt 23 may be replaced by intermediate cog or equivalent power transmitting devices.

Dashed line 25 and an arrow 26 show the position and moving direction of the continuous form paper toward the printing device 6. Dashed line 27 and an arrow 28 show the position and moving direction of the continuous form paper leaving the printing cylinder 7 of the printing device 6.

FIG. 2 shows a view of one end side of the input cylinder 8 and of the output cylinder 10, as journalled in the holding plate 19, partly broken-away, and with power transmitting devices in the form of cog wheel plates 22, 24 and the cog belt 23. For clarity in FIG. 2, the compression cylinder 9 has been omitted. It will be observed that the metal spindles 11, 13 of both cylinders are enveloped by plastic bushings. Axial screws 29 are fixed on the metal spindles 11, 13 of the input cylinder 8 and the output cylinder 10 to retain cog wheels 22, 24. Over the cog wheel plates 22, 24, the cog wheel 23 rotates.

Figure 3:
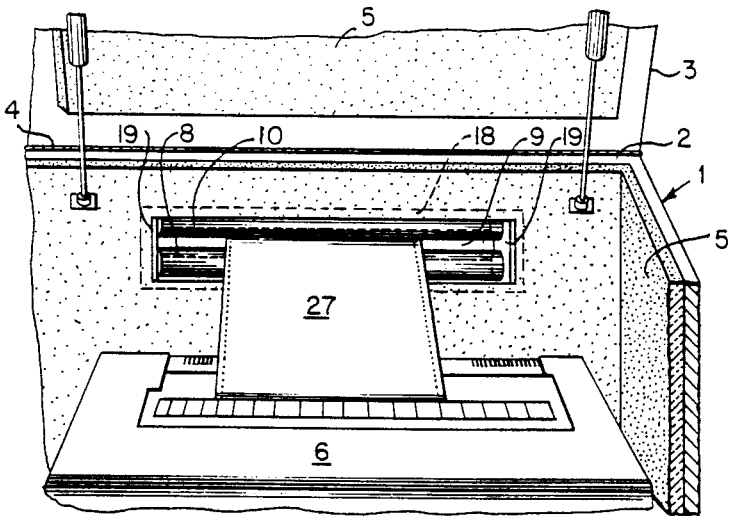
FIG. 3 a perspective view of the inside of a sound cover box in which a printing device is supported from which continuous form paper is guided out with help of the paper transport device.

FIG. 3 shows a view of the sound cover box 1 with open cover 3 in the direction toward the back wall of the sound cover box. A continuous form paper 27 is shown as coming out of the printing device 6 and as being guided through the slit between the compression cylinder 9 and the output cylinder 10.

Figure 4:
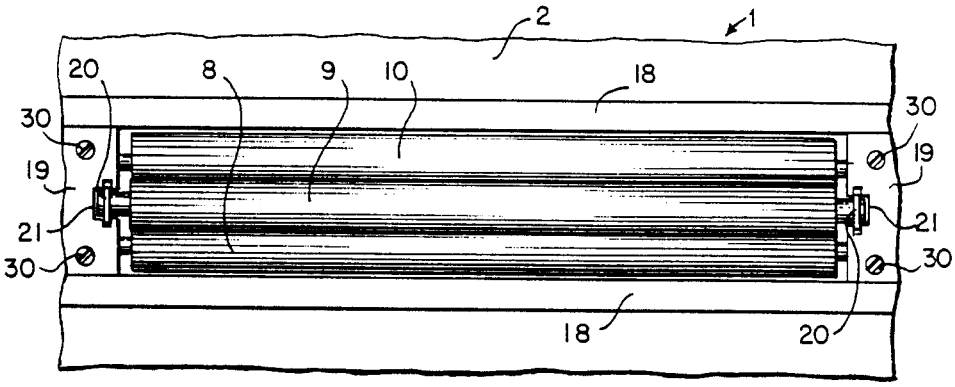
FIG. 4 a perspective view of the paper transport device in the back part of a sound cover box.

FIG. 4 shows a view of the transport device from the exterior of the back wall 2 of the sound cover box 1. The cylinders 8, 9, 10 are mounted on both holding plates 19, which are fixed each of them with two screws 30 at the back wall 2 of the sound cover box 1.

Figure 5:
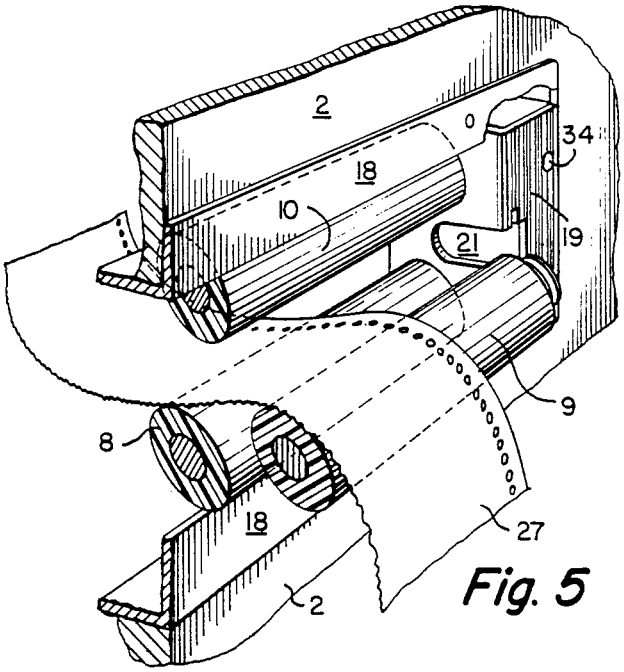
FIG. 5 is a partly perspective view of the paper transport device at the outer side of the sound cover box and in close proximity to a holding plate associated with the cylinders.

FIG. 5 shows a part of the paper transport device at the exterior of the sound cover box 1, with the compression cylinder 9 having been removed from engagement with the store plate 19, so that the notches 21 can be better seen.

OPERATION

In the operation of the paper transport device, the continuous form paper has to pass around the input cylinder 8, the printing cylinder 7 and the output cylinder 10. To make it easier to thread the paper through this path, the compression cylinder 9 is moved from its operating position between the input cylinder and the output cylinder. In operation, the printing cylinder 7 rotates in the direction of the arrow 31 in FIG. 1 and pulls the continuous form paper accordingly to the interrupted line 25 in the printing direction 6. By means of the screw springs 17, the compression cylinder 9 is pressed firmly against the input cylinder 8. Therefore, a slip between the continuous form paper and the two cylinders 8, 9 is ordinarily avoided.

The pulling of the paper into the printing device 6 causes rotation of the input cylinder 8 and the compression cylinder 9. Because of the power transmitting connection between the input cylinder and the output cylinder 10, the latter is automatically put into rotation. This rotation is also transferred to the compression cylinder 9, which by means of the screw springs 17, is pressed against output cylinder 10. The continuous form paper, symbolized by the dashed line 27 coming out of the printing device 6, is pulled away between the compression cylinder 9 and the output cylinder 10. In this manner, as shown at A in FIG. 1, blocking of the continuous form paper between the printing cylinder 7 and the output cylinder 10 cannot happen. The tension of the continuous form paper in the vicinity of A can be increased when the power transmitting devices between the input cylinder 8 and the output cylinder 10 are regulated in such a way that the output cylinder 10 rotates at a higher rotational speed than does the input cylinder 8.

A motor for the paper transport device is unnecessary. The cylinders 8, 9, 10 are installed in such a manner that the movement of the continuous form paper around the printing cylinder 7 causes all of the needed rotation of the cylinders 8, 9, 10. Furthermore, with help of the power transmitting mechanisms among the cylinders 8, 9, 10, the speed of the paper transport can be regulated, so that the continuous form paper leaves the printing device 6 with at least the same speed as the cylinder 7 of printing device 6.

Thus, in accordance with the present invention, a sure paper transport without pinching and blocking the paper transport of the continuous form paper is guaranteed. The paper transport device can be at the place where the printed continuous form paper is coming out of the transport device equipped with a brush like, conducting device of electricity to unload and conduct electro static energy from the surface of the continuous form paper. So on both sides of the channel in which the continuous form paper is transported, an aluminum-stripe with brush like fibers is positioned, for instance with electricity conducting hair like carbon fibers. These fibers touch the paper which is coming out of the paper transport device and conduct electrical energy which might be existing there. This conduction is to be realized easily when the aluminum-stripes are connected in the usual way conducting electricity with the ground. Therefore a normal electric cable can be used ground cable is connected with a ground cable of a matching electrical wall-socket.

The 3 cylinders are installed in tight engagement with each other and in contiguity with the opening in the backside wall so that sound cover box is practically completely closed. Thus, beside the reliable paper transport, the desired sound protection is also guaranteed.

According to a preferred model, realization the open distance between the input cylinder 8 and the output cylinder 10 is smaller than the diameter of the compression cylinder 9. Thus, the compression cylinder 9 is pressed without problems at the same time to the input cylinder 8 and the output cylinder 10, so that a slip between the cylinders and the continuous form paper is mostly prevented and the distances between the cylinders can be kept very small.

It has proved to be very useful that the compression cylinder 9 is regulated by springs which control the pressure against both the input cylinder 8 and the output cylinder 10. The reason for this is that the pressure is thereby regulated according to the thickness and quality of the continuous form paper. Furthermore, the power of the springs helps to keep the slip between the continuous form paper and the cylinders as small as possible.

I claim:

1. A printing system having a paper input port and a paper output port; said printing system comprising:

(a) a printing cylinder;

(b) an input cylinder;

(c) an output cylinder; and (d) a compression cylinder;

(e) the axes of said printing cylinder, said input cylinder, said output cylinder, and said compression cylinder being parallel;

(g) said input cylinder and said output cylinder being remote from each other;

(h) said compression cylinder being loaded for compression against both said input cylinder and said output cylinder;

(i) whereby said system establishes a paper path from said input port, between said input cylinder and said compression cylinder, around said printing cylinder, and between said output cylinder and said compression cylinder to said output port;

(j) said input cylinder, said output cylinder and said compression cylinder being powered only by said printing cylinder and only when a length of paper extends through said path.

2. The printing system of claim 1 wherein the distance between said input cylinder and said output cylinder is less than the diameter of said compression cylinder.

3. The printing system according to claim 1 or claim 2, where in said compression cylinder is spring loaded.

4. The printing system according to claim 1, said printing system comprising drive means including cog wheels operatively connected to said input cylinder and said output cylinder, and a toothed belt operatively connected to said cog wheels.

5. The printing system according to claim 1 such that said output cylinder rotates at least as rapidly as said input cylinder.

6. The printing system according to claim 1, characterized in that each of said input cylinder, said output cylinder and said compression cylinder includes an inner steel spindle and an outer foamed surface material.

7. The printing system of claim 1, characterized in that said input cylinder, said output cylinder, said compression cylinder and said print cylinder are contained within a sound absorbing housing.

8. The printing system of claim 1, wherein a brush-like, electrically-conductive means is arranged adjacent to said output cylinder for receiving and discharging electrostatic charges from the surface of paper advancing through said path.

* * * * *